US005369926A

United States Patent [19]

Borland

[11] Patent Number: 5,369,926

[45] Date of Patent: Dec. 6, 1994

[54] INSULATION BOARD FOR PLAZA DECK CONSTRUCTION

[75] Inventor: Dean T. Borland, Chicago, Ill.

[73] Assignee: The Dow Chemical Company, Midland, Mich.

[21] Appl. No.: 114,259

[22] Filed: Aug. 30, 1993

[51] Int. Cl.[5] ..... E04B 7/00; E04C 2/10; E04C 2/32

[52] U.S. Cl. ..... 52/302.1; 52/309.4; 52/309.8; 52/309.12; 52/309.17; 52/408; 52/741.4; 52/747; 428/158; 428/160; 428/163

[58] Field of Search ..... 52/309.4, 309.8, 309.12, 52/309.17, 302.1, 302.4, 408, 410, 741.4, 747; 428/156, 158, 160, 163, 167

[56] References Cited

U.S. PATENT DOCUMENTS

| | | | |
|---|---|---|---|
| 3,000,144 | 9/1961 | Kitson | 52/309.12 X |
| 3,016,317 | 1/1962 | Brunner | 428/158 X |
| 3,222,697 | 12/1965 | Scheermesser | 428/160 X |
| 4,703,604 | 11/1987 | Muller | 52/741.4 |
| 5,160,785 | 11/1992 | Davidson | 428/160 X |

*Primary Examiner*—Carl D. Friedman
*Assistant Examiner*—Robert J. Canfield

[57] ABSTRACT

The specification discloses foam insulation board for use in plaza deck construction, the upper and lower surfaces of which contain drainage channels. To avoid problems of easy breakage, especially of the kind associated with larger foam insulation boards having upper and lower drainage channels, the present invention discloses orienting the lower surface drainage channels 90° with respect to the upper surface drainage channels, such that the two opposing surfaces of channels are perpendicular to each other.

20 Claims, 1 Drawing Sheet

INSULATION BOARD FOR PLAZA DECK CONSTRUCTION

BACKGROUND OF THE INVENTION

The present invention relates to insulating foam of the type used for constructing plaza decks or the like. Typically, plaza deck is comprised of a structural support deck, an overlying, waterproof membrane, an intervening foam insulation board, and a concrete wearing slab. Several problems with this plaza deck composite have been identified by and are well-known to the industry. First, moisture tends to accumulate between the concrete wearing slab and the waterproof membrane, compromising the insulating value of the foam insulation board and often causing the freeze/thaw spalling of the concrete wearing slab. In response to this problem, the common practice in the art has become the addition of a drainage layer between the foam insulation and the concrete wearing slab. In certain applications, an additional drainage layer between the foam insulation and the waterproof layer is also desirable. In either case, the drainage layer(s) mitigates the harmful affects of moisture accumulation in the foam insulation board.

Previously, the standard industry method called for the use of loose gravel or epoxy bound gravel as the drainage layer. However, U.S. Pat. Nos. 4,658,554 and 4,712,349 both disclose a foam insulation layer whose upper surface is sculpted to include a series of parallel drainage channels flanked by raised, rib-like walls. In both of these patents, it is further provided that the lower surface of the foam insulation board is laminated with a plastic film so as to prevent the migration of moisture vapor from the waterproof membrane through the interface between the insulation board and the concrete wearing slab. Both of these patents thus provide for the retardation of moisture accumulation as well as the drainage of accumulated moisture, without the use of loose or epoxy-bound gravel.

A second problem with the typical plaza deck composite, not addressed by either the '554 or '349 patents, is the addition of the concrete wearing slab. Since the concrete wearing slab must be laid directly on the/barn insulating layer, the standard practice was to form concrete wearing slabs at one location, ship them to the construction site, and place them upon the foam insulating board. One solution to this problem is offered by U.S. Pat. No. 5,067,298, which discloses a method whereby the concrete wearing slab can be formed directly at the construction site. A layer of fabric, interposed between the foam insulation layer and the wearing slab, permits wet concrete to be poured directly onto the insulation layer without clogging the drainage channels on the upper surface thereof.

U.S. Pat. No. 5,067,298 discloses providing parallel drainage channels on both the top and bottom surfaces of the loam. The '298 foam may also include perpendicular sets of parallel channels on one or both sides of the foam. However, top and bottom sets of channels are disclosed as being parallel (though claimed more broadly), creating a narrower loam board cross section between the bases of the parallel top and bottom channels, extending across the board width or length.

SUMMARY OF THE INVENTION

In the present invention, drainage channels are incorporated into the upper and lower surfaces of foam insulation board used in plaza deck construction, but the upper and lower channel sets are generally perpendicular so that the board is narrowed in cross section only at isolated points, in checkerboard fashion rather than entirely across the width or length of the board. This makes ii more difficult to break the board as a result of narrower cross sections where channels are parallel or nearly parallel.

These and other objects and advantages of the present invention will be more dearly understood with reference to the attached drawings and appended claims.

DESCRIPTION OF THE PREFERRED EMBODIMENT

Figure 1:
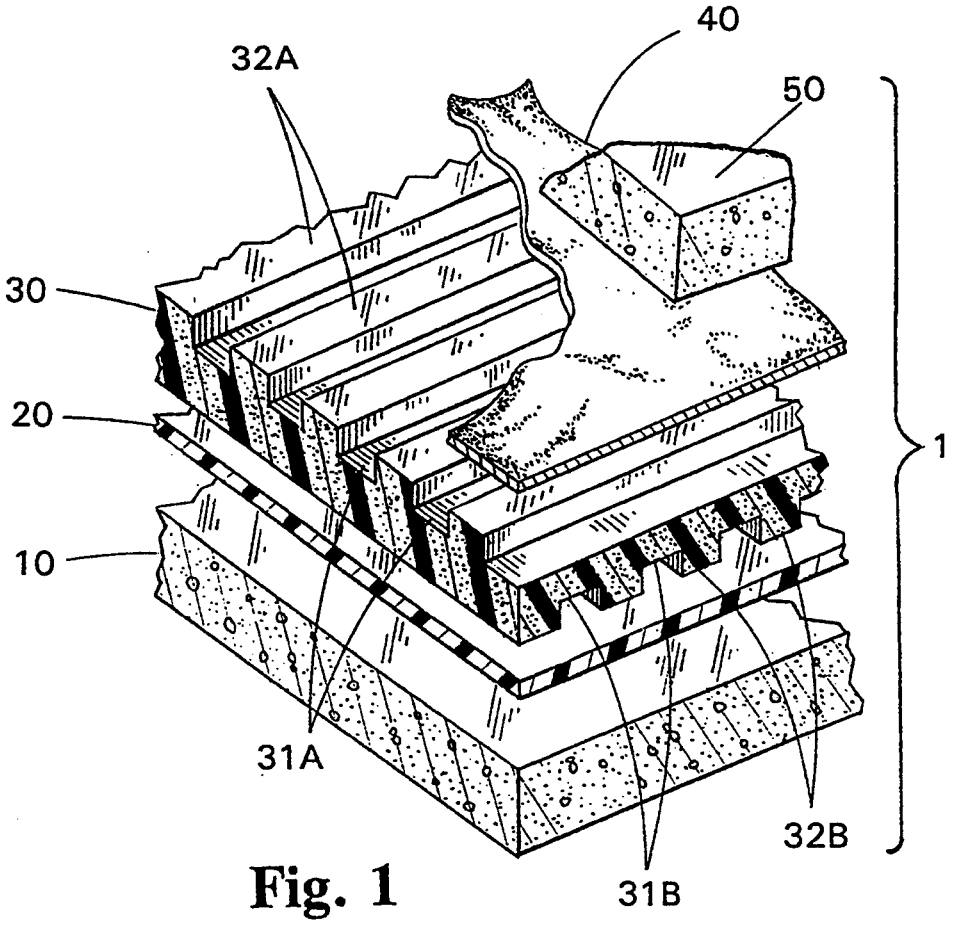
FIG. 1 is a fragmentary perspective view showing the perpendicular drainage channel arrangement of the present invention.

In the plaza deck composite 1 of the preferred embodiment (FIG. 1), a base deck 10 underlies a waterproof membrane 20. Membrane 20, which can be either attached to or placed loosely on top of base deck 10, is covered by a foam insulating layer 30, having a series of drainage channels 31A and 31B on its upper and lower surfaces, respectively. A fabric-like layer 40 is sandwiched between the upper surface of insulating layer 30 and a concrete wearing slab 50.

Both base deck 10 and concrete wearing slab 50 are preferably made of reinforced concrete or the like.

Waterproof membrane 20 is preferably a single sheet of polymeric material, liquid applied material, modified bituminous sheet or an asphalt built-up membrane.

Fabric-like layer 40, adhered to the top surface of insulation layer 30 by an adhesive, is sufficiently porous to permit the passage of water into upper drainage channels 31A, but not so porous as to permit the wet concrete of cement wearing slab 50 poured thereon to permeate upper drainage channels 31A. A preferable material for this application is either fiberglass or polypropylene fabric, having a weight per panel of approximately 4.10 ounces per square yard and a grab strength, in pounds, of about 115; a rating of around 140 gpm/ft$^2$ for flow; and an equivalent opening size in U.S. units of 70 to 100.

Figure 2:
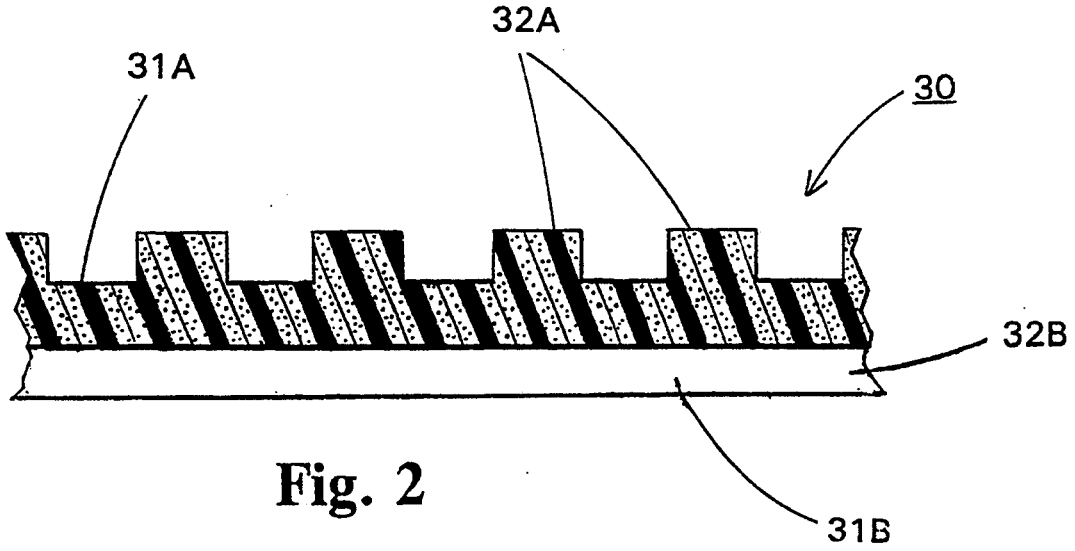
FIGS. 2 is a cross-sectional view of the foam panel of the present invention, taken through one of the bottom channels.

Foam insulation layer 30 includes a series of first set parallel channels 31A on its upper surface, as well as a series of second set parallel channels 31B on its lower surface (FIG. 2). The series of channel 31A along the top surface of insulation layer 30 run in a direction generally perpendicular to that of channels 31B located on the lower surface. Separating each of the channels 31A and 31B is a rib 32, having a height and width approximately the same as channels 31A or 31B. Foam layer 30 is itself preferably constructed from existing plaza deck foam-insulation board, such as the closed-cell type polystyrene of the Dow Styrofoam®. Thermadry TM 1250 or 1750 brands. Styrofoam® Brand Products, 2020 Willard II. Dow Center, Midland, Michigan 48674. Thermadry TM Brand foam insulation board ranges in thickness from 1.5 to 2.55 inches. Its compressive strength is between 1250 psf and 1750 psf; its minimum flow rate in gpm/ft (width) is 5; and its R-value ranges from 6.9 to 10.6 h.ft$^2$°F./btu.

Since this brand of insulation board is usually extruded with parallel channels over its upper surface, additional drainage channels, oriented 90° with respect to the existing drainage channels, can simply be added by one of several methods well-known to the art. Such methods include cutting the channels after the foam panel is formed. In this method, the channels can be effectively cut by a router, a hot wire, or a hot knife. Alternatively, the loam board could be molded (rather than extruded) to have perpendicular top and bottom channels.

Since product size is not a critical factor, the foam panels can vary in length from one-quarter foot to four feet with a width of anywhere from four feet to twenty feet. However, handleability is an important consideration, so the panels should not be so large as to blow down from a roof or plaza deck before the concrete wear slab can be applied to hold them down.

The drainage channels 31A and 31B on the top and bottom surfaces of foam insulation layer 30 have a variable width of one-sixteenth of an inch to one-inch and a variable depth of one-tenth of an inch to one-inch.

The ribs 32A and 32B along the top and bottom surfaces of foam insulation board 30 vary in width from one-eighth inch to five inches, with a depth corresponding to the depth of the adjacent channel.

The indicated dimensions for the foam panel itself, the top and bottom drainage channels, and the ribs yield a ratio of total channel area to total surface area of the foam panel of approximately 50%.

The compressive strength of the foam panels of the preferred embodiment varies from 1440 pounds per square foot (psf) to 28,800 psf. Accordingly, the compressive strength must be greater where channel depth is decreased, in order to compensate for increases in the weight of concrete wearing slab 50.

Similarly, the foam material at ribs 32A and 32B is stronger and more resistant to deformation than are the longitudinal side edges of foam layer 30. Again, this prevents the unwanted compression of foam layer 30 and the resultant decrease in the size of drainage channels 31A and 31B caused by the weight of wearing slab 50.

Semi-porous fabric layer 40 is adhered to the top surface of foam layer 30 by an adhesive, such as a hot melt or a one-part or two-part urethane adhesive. Fabric layer 40 is adhered only to the top surfaces of ribs 32A, so that drainage channels 31A are left open. In order for moisture to pass into drainage channels 31A, fabric layer 40 is somewhat porous. However, fabric layer 40 is not so porous as to permit the wet concrete of a poured wearing slab to substantially penetrate into drainage channels 31A, thus reducing their effectiveness. To this end, fabric layer 40 can be constructed of either nonwoven or woven fabric, including polypropylene or fiberglass. Typical standards for fabric layer 40 include: a weight per panel in ounces per square yard of 4.10 and a grab strength, in pounds, of 115; rating of 140 gpm/ft$^2$ for flow; and an equivalent opening size on U.S. units of 70 to 100.

In use, waterproof membrane 20 is placed upon base deck 10. Foam panels 30, fabric-covered channels 31A facing up, are then closely arranged such that the smooth edges of adjacent panels abut. When all of the foam insulation board 30 is in place, the concrete wearing slab is poured over fabric layer 40 and allowed to cure. During this pouring procedure, fabric layer 40 prevents the wet concrete from entering into and compromising the effectiveness of drainage channels 31A. In the broader aspects of the invention, the concrete wear slab can be precast, cured, and laid in place over foam board 1.

The present invention provides upper 31A and lower 31B drainage channels to prevent degradation of the insulating properties of foam layer 30 when moisture becomes trapped in foam layer 30. Further, the present invention provides for the perpendicular orientation of the top row of drainage channels 31A with respect to the bottom row of drainage channels 31B. Especially in applications where the foam panels 30 have a length and width of four feet and twenty feet, respectively, this perpendicular arrangement of the drainage channels increases the rigidity of and makes it more difficult for a user to accidentally break a foam panel 30 along a narrowed cross section. As can be the case in foam panels of the prior art, where drainage channels on the top surface are adjacent to and run in the same direction as drainage channels on the bottom surface, a panel can be accidentally broken along any of the adjacent top and bottom channels, since the foam panel is thinnest at that point. The present invention overcomes this problem, since the perpendicular orientation of top 31A and bottom 31B drainage channels isolates the areas of minimum panel thickness to spaced points, in a checkerboard fashion.

Of course, it is understood that the above is merely a description of the preferred embodiment only, and that various changes and alterations to the present invention, obvious to those skilled in the art, can be made without departing from the spirit and broader aspects thereof as defined in the claims.

The embodiments of the invention in which an exclusive property or privilege is claimed are defined as follows:

1. Insulation panel, for use in constructing horizontal parking structures, plaza decks, and the like, comprising:

a panel of foam material having first and second sets of generally parallel drainage channels located in opposing top and bottom surfaces of said panel, respectively, said first set channels on said top surface being oriented generally perpendicular to said second set drainage channels on said bottom surface, said panel being free of generally parallel top and bottom channels, whereby points of narrow cross section between top and bottom channels are isolated in a checkerboard fashion rather than running the full length or full width of said panel.

2. The insulation panel of claim 1, wherein said channels on said upper surface and said channels on said bottom surface each have a width of around one-sixteenth inch to one-inch and a depth of approximately one-tenth inch to one-inch.

3. The insulation panel of claim 2, said panel having variable dimensions of around one-quarter to four feet long and anywhere from four feet to twenty feet wide.

4. The insulation panel of claim 3, wherein said panel is comprised of polystyrene foam.

5. The insulation panel of claim 4, wherein said polystyrene foam is of the closed-cell variety.

6. The insulation panel of claim 4 including a layer of porous fabric over said first set channels.

7. The insulation panel of claim 2 including a layer of porous fabric over said first set channels.

8. The insulation panel of claim 1 including a layer of porous fabric over said first set channels.

9. The insulation panel of claim 1, wherein said panel is comprised of polystyrene foam.

10. The insulation panel of claim 1, said panel having variable dimensions of around one-quarter to four feet long and anywhere from four feet to twenty feet wide.

11. A method for constructing a plaza deck/parking structure comprising:

providing a plurality of panels of foam plastic insulation having first and second sets of generally parallel drainage chapels located in opposing top and bottom surfaces of said panel, respectively, said first set chapels on said top surface being oriented generally perpendicular to said second set drainage chapels on said bottom surface, said panel being free of generally parallel top and bottom chapels, whereby points of narrow cross section between top and bottom channels are isolated in a checkerboard fashion, rather than running the full length of full width of said panel;

providing a base deck:

placing a waterproof membrane on top of said base deck;

placing said plurality of foam plastic panels on top of said waterproof membrane, and installing a concrete wear layer over said panels.

12. The method of claim 11, wherein said channels on said upper surface and said channels on said bottom surface are each provided with a width of around 1.16 inch to 1 inch and a depth of approximately 1.10 inch to 1 inch.

13. The method of claim 12 in which said panels are provided in dimensions of from ¼ to 4 feet long and from 4 feet to 20 feet wide.

14. The method of claim 13 wherein said panels are made of polystyrene foam.

15. The method of claim 14 wherein said polystyrene foam is of the closed cell variety.

16. The method of claim 14 which includes placing a layer of porous fabric over said first set channels and affixing said layer to the top of said ribs on each of said panels.

17. The method of claim 12 which includes placing a layer of porous fabric over said first set channels and affixing said layer to the top of said ribs on each of said panels.

18. The method of claim 11 which includes placing a layer of porous fabric over said first set channels and affixing said layer to the top of said ribs on each of said panels.

19. The method of claim 11 wherein said panels are made of polystyrene foam.

20. The method of claim 11 in which said panels are provided in dimensions of from ¼ to 4 feet long and from 4 feet to 20 feet wide.

* * * * *

UNITED STATES PATENT AND TRADEMARK OFFICE

CERTIFICATE OF CORRECTION

PATENT NO. : 5,369,926

DATED : December 6, 1994

INVENTOR(S) : Dean T. Borland

It is certified that error appears in the above-identified patent and that said Letters Patent is hereby corrected as shown below:

Column 5:

In Claim 11, lines 12, 14, 16, and 18, please delete each occurrence of "chapels" and replace with --channels--.

Signed and Sealed this

Twentieth Day of February, 1996

*Attest:*

*Attesting Officer*

Bruce Lehman

BRUCE LEHMAN

*Commissioner of Patents and Trademarks*